United States Patent [19]

Joseloff

[11] 4,265,335

[45] May 5, 1981

[54] CHECK-OUT COUNTER

[76] Inventor: Stanley S. Joseloff, 217 Webb Rd., Fairfield, Conn. 06430

[21] Appl. No.: 86,270

[22] Filed: Oct. 19, 1979

[51] Int. Cl.[3] ..... A47F 9/04

[52] U.S. Cl. ..... 186/63

[58] Field of Search ..... 186/62, 63, 64, 65, 186/67, 66, 68

[56] References Cited

U.S. PATENT DOCUMENTS

| | | | |
|---|---|---|---|
| 2,631,689 | 3/1953 | Rubaloff | 186/66 |
| 3,011,593 | 12/1961 | Foster | 186/63 |
| 3,219,148 | 11/1965 | Stern, Jr. et al. | 186/65 |

*Primary Examiner*—Stanley H. Tollberg
*Attorney, Agent, or Firm*—Charles E. Temko

[57] ABSTRACT

A counter is recessed along the customer aisle on the front end thereof in order to permit the customer to push the cart into the customer aisle and unload the cart within the aisle by standing at the side or front end of the cart and removing items to transfer them to the counter without interference from the handle at the rear of the cart. The counter is also recessed on the customer side of the aisle opposite the cashier to permit the customer once again to stand at the side of the cart and transfer items from the counter into open empty bags placed upon the floor of the cart, or to fill the bags on the counter and deposit them in the cart.

2 Claims, 1 Drawing Figure

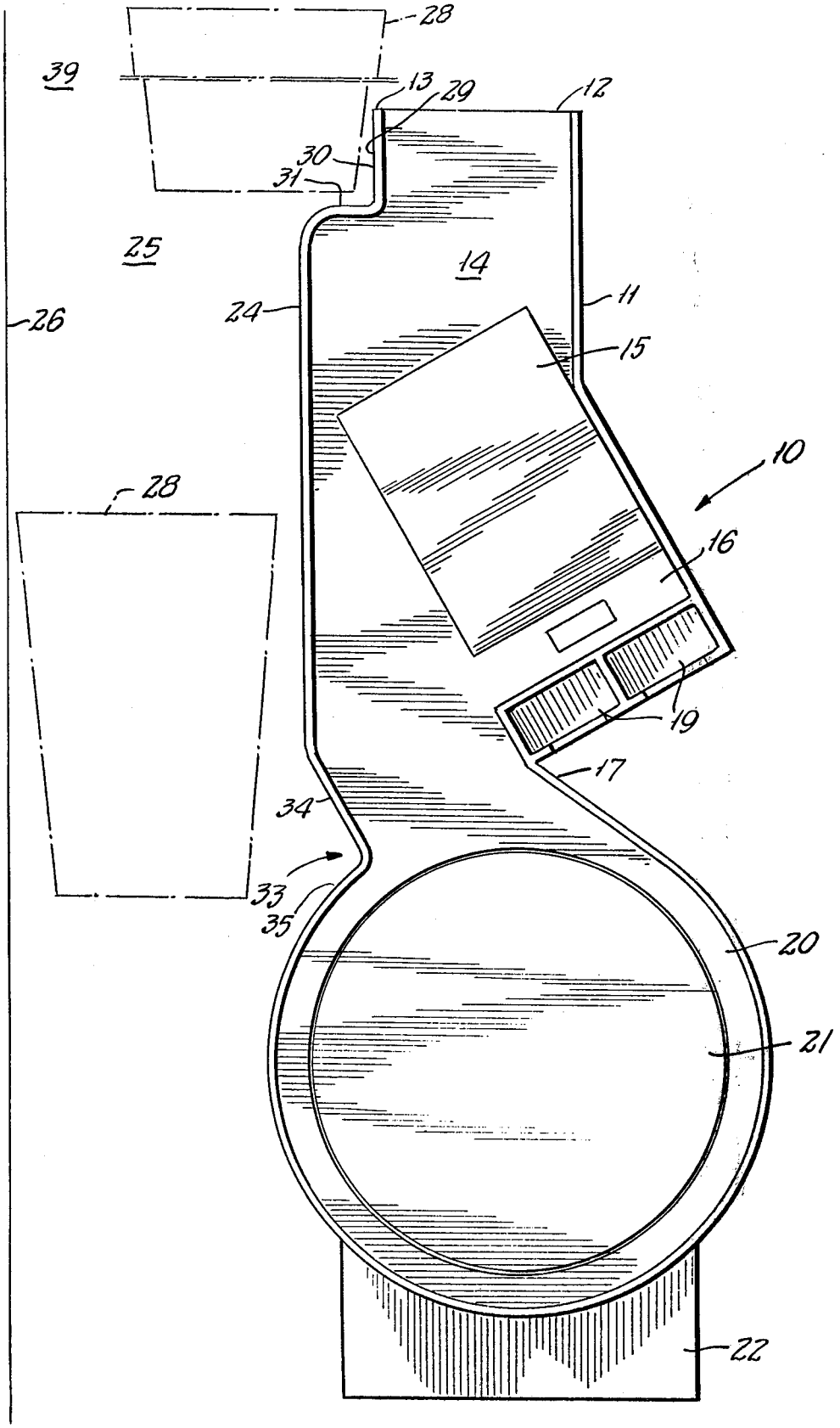
28
39
13
29
12
30
31
25
14
11
26
24
15
10
28
16
19
17
34
33
35
20
21
22

CHECK-OUT COUNTER

RELATED APPLICATION

Reference is made to my copending application, Ser. No. 21,588 filed Mar. 19, 1979, which discloses a related invention.

BACKGROUND OF THE INVENTION

This invention relates generally to the field of check-out counters for supermarkets and the like, and more particularly to an improved form thereof adapted to expedite the flow of customers and merchandise through retail establishments in which they are installed.

In my above mentioned copending application, there is disclosed a check-out counter in which means is incorporated on the customer side of the counter, accessible from the aisle for serially dispensing bags, and positioning them in a recess in the counter so that, after checking, a customer who is so inclined, may assist the cashier in bagging tallied items, thereby expediting the flow of traffic by providing the cashier with bagging assistance. While not without utility, this structure only partially solves the traffic flow problem. Customers generally unload the carts at the check-out counters, since when positioned at the leading end of the counter, they are inaccessible to the cashier who normally stands in a bay adjacent the cash register or scanner mechanism located downstream. The aisle through which the cart is pushed is normally just sufficiently wide to accommodate the cart. It follows that there is no way of pushing the cart into the aisle and removing items from the rear of the cart in easy fashion, since such operation is inhibited by the height of the cart handle. The customer must engage in the difficult, time-consuming effort of getting positioned in front of a full cart and pulling the cart into the check-out aisle. It is virtually impossible for the customer to be positioned at the side of the cart and to unload items from such a position, since the aisle is, as has been mentioned, only a few inches wider than the width of the cart itself. The only alternative under such circumstances is for the customer to position the cart in front of the counter, outside the check-out aisle while unloading the cart. This solution not only elongates the line of customers waiting to be checked out, but also obstructs the flow of traffic created by other customers who have not completed their shopping.

SUMMARY OF THE INVENTION

Briefly stated, the invention contemplates the provision of a novel counter configuration which solves the above mentioned problem. The counter is provided with a recess at the front end thereof which permits the customer to push the shopping cart into the check-out aisle to unload it. In so doing, the cart is removed from an obstructive position in front of the counter where, as now frequently occurs, it interferes with shopping traffic located between merchandise counters and the check-out counters. Another recess on the customer side of the check-out counter located opposite the cashier bay facilitates customer bagging and/or loading bags and items over the front or sides of the cart within the aisle. Thus, the front end of the counter adjacent the customer check-out aisle is recessed whereby the customer may push the cart into the recess, enabling her, while standing in the aisle, to walk past the cart and unload it from either the front or side of the cart. After such process, the customer moves downstream to position herself in the second recess opposite the cashier, where she may obtain bags from a serial dispenser facing the check-out aisle and position them in the cart to directly load tallied items into the bags. Alternatively, she may position open bags on the counter downstream from the cashier, and bag the items there, prior to transferring loaded bags to the cart. This alternative gives the customer the opportunity to distribute relatively heavy items among a plurality of open bags so that the loaded weight of each is approximately the same, facilitating subsequent handling after leaving the supermarket.

BRIEF DESCRIPTION OF THE DRAWING

In the drawing, to which references will be made in the specification, the single FIGURE is a top plan view of an embodiment of the invention.

DETAILED DESCRIPTION OF THE DISCLOSED EMBODIMENT

With reference to FIG. 1, in accordance with the invention, the device, generally indicated by reference character 10, comprises an elongated counter element 11 having a principal longitudinal axis and including a head or leading end 12 adjacent an unloading or receiving station 13, the upper surface 14 of the counter surrounding a powered conveyor belt of known type 15 which leads to a cashier station 16 where items placed on the conveyor belt are serially tallied. A cashier (not shown) normally stands in an angularly disposed bay 17 immediately behind a scanner mechanism 18, or where a scanner mechanism is not present, adjacent a cash register (not shown), suitably positioned to be operated by the right hand of the cashier. Loading bag wells 19 are positioned immediately downstream from the scanning mechanism, to permit tallied items to be immediately moved to the open mouths of bags disposed within the wells. As each bag is filled, it may be lifted by the cashier, and placed upon the upper surface 14 of the counter for transfer by the customer to a waiting cart. Downstream from the cashier station 16 is a storage station 20, which preferably includes a rotary table 21, and optionally includes a rear loading platform 22 for use by store personnel, when available, to speed bagging operations.

The leftward (as seen in FIG. 1) edge 24 of the counter 11 borders a customer aisle 25 defined by a wall 26 or adjacent checking station (not shown). Normally this edge is just sufficiently wide to accommodate a shopping cart 28, and when the cart is in the aisle, it is physically impossible for a customer to walk from the rear of the cart to the front of the cart for the purposes of loading or unloading the same.

To overcome this difficulty, a first recess 29 is provided at a leading corner formed by first and second sides 30 and 31 which define a rectangular area approximately 8 to 10 inches square. A second recess 33 extends into the edge 24 at a point approximately opposite the cashier station to a depth of approximately 8 to 10 inches. It is bounded by converging surfaces 34 and 35, and permits a customer to position himself ahead of the cart 28 after he has moved the same downstream to a position approximately opposite the cashier station.

At this point in the disclosure, the operation of the counter may be adequately described. With the arrival of a loaded cart at the end 12 of the counter, the customer docks the cart in the first recess 29. This movement immediately provides a space 39 through which she can walk past the cart to the front end of the cart, where, unhindered by the relatively high handle mounted on the rear end of the cart, she can unload the contents of the cart onto the belt 15 in serial fashion as the cashier commences the checking operation. As movement of the belt is under control of the checker, it may be advanced as rapidly as the cashier can perform the checking operation, normally at least as fast as the customer can unload the cart. With the completion of the unloading operation, the customer then moves downstream within the aisle, pulling the cart with her until she arrives at the second recess 33. By this time, the cashier will have filled several bags (not shown), and transferred them from the wells 19 to the surface 14 adjacent the second recess 33. The customer, having substantial mobility at this time, can immediately transfer those bags which are ready to the cart, and, if time is available, can position additional open bags in the cart received from a dispensing means of the type disclosed in my above mentioned copending application. Where a very large number of items is being unloaded at one time, the cashier will reach a point where she is no longer able to keep up with the flow of the same on the conveyor belt with both a checking and bagging function, and at this point excess items which cannot be bagged into bags in the wells which are already filled, may be allowed to move further downstream to be placed on the rotary table 21. The customer, if so inclined, can retrieve items from the rotary table 21 and place them in the empty bags in the cart, thus supplementing the bagging operation. If the customer is not so inclined, the excess items remain on the table until the cashier has completed tallying all of the items for that customer, and may then perform such additional bagging operations as may be necessary.

It may thus be appreciated that I have provided an improved checking counter which includes all of the facilities necessary to encourage a customer to assist in bagging operations, should the customer desire to do so. It can be expected that not all customers are willing to participate, and in such cases, a storage area provides for the accommodation of tallied items until time is available to the cashier to bag them. Even where the customer does not participate in bagging, she can position herself in front of the cart while the same is in the aisle, to facilitate the unloading of untallied items from the cart, and to package and arrange loaded bags provided by the cashier, who cannot normally transfer a heavy bag across the counter to a cart located in the aisle. This is accomplished by the provision of first and second recesses, a first of which permits the cart to be docked adjacent the counter and the customer to walk past the cart while it is in the customer aisle. A second recess unables the customer to position herself in the area where a clerk would place a loaded bag removed from the loading well, and transferred to a cart without difficulty. In some cases, it is possible to incorporate the inventive structure in existing counters with relatively little difficulty, thereby materially lowering the cost of installation.

I wish it to be understood that I do not consider the invention limited to the precise details of structure shown and set forth in this specification, for obvious modifications will occur to those skilled in the art to which the invention pertains.

I claim:

1. In a checkout counter for supermarkets and the like having a peripheral longitudinal axis with a receiving station at a forward end thereof equipped with a conveyor means for the receipt and transport of items deposited thereon by a customer on a customer's side of the counter, a storage station positioned on a second end of said counter and a cashier's station receiving items to be tallied from said conveyor, there being an aisle of effective width to accommodate a shopping cart for passage along side said counter from said forward end to a rearward end thereof, the improvement comprising: a recess in said counter extending from said forward end of width less than that of said aisle, and adapted to accommodate a substantial portion of the width of a shipping cart therein at the customer's side of said counter, whereby when a cart is so positioned a customer may move easily around and reach into it within said aisle; and a second recess in said counter on the customer's side thereof facing said aisle and positioned adjacent said cashier's station for permitting customer mobility within said aisle and around a cart in the close proximity of said cashier's station.

2. The improvement in accordance with claim 1, further comprising a rotary table overlying said storage station providing access to unbagged items to both a customer and a cashier.

* * * * *